US005644871A

United States Patent [19]

Cohen et al.

[11] Patent Number: 5,644,871

[45] Date of Patent: Jul. 8, 1997

[54] MODULAR BUILDING SYSTEM

[75] Inventors: Ben-Zion Cohen, Pardesiya; Eliyahu Gonen, Natanya, both of Israel

[73] Assignee: Eli Gonen, Israel

[21] Appl. No.: 503,664

[22] Filed: Jul. 18, 1995

[51] Int. Cl.[6] ..... E04B 1/00; E04B 5/02

[52] U.S. Cl. ..... 52/125.1; 52/125.4; 52/251; 52/389; 52/125.5

[58] Field of Search ..... 52/125.1, 125.4, 52/125.5, 251, 389, 385, 404.2

[56] References Cited

U.S. PATENT DOCUMENTS

| | | | |
|---|---|---|---|
| 1,066,436 | 7/1913 | Peltzer | 52/125.1 X |
| 1,362,069 | 12/1920 | Witzel | 52/125.5 X |
| 2,859,530 | 11/1958 | Renaud | 52/125.4 X |
| 3,035,816 | 5/1962 | Stubbs et al. | 52/125.1 X |
| 3,521,418 | 7/1970 | Bartoloni | 52/389 X |
| 3,913,287 | 10/1975 | Chapman | 52/125.4 X |
| 3,952,471 | 4/1976 | Mooney | 52/125.4 X |
| 4,432,177 | 2/1984 | Amesso et al. | 52/389 X |
| 4,909,001 | 3/1990 | de Los Monteros | 52/251 X |

*Primary Examiner*—Wynn E. Wood
*Attorney, Agent, or Firm*—Dvorak and Traub

[57] ABSTRACT

A modular building system including modules for a majority of structural elements making up a modem building. Modules include, floors, walls, elevator shafts, stairways, conduit assemblies. Facilities located on or off site are utilized to prefabricate most of the structural elements needed to construct a building. Finished floor modules are complete sections of floor including floor core, floor covering, insulation, ceiling beams and ceiling below. Wall modules include wall core, exterior wall covering, utility runs, wall beams and interior wall covering. Elevator modules include stackable elevator shells and guide tracks. Stairway modules include stackable stairway shells that may be stacked as many number of floors as needed. Utility conduit assemblies include all related utility meter gear and cabling, plumbing, etc. for gas, water, electricity, telecommunications, etc. services.

6 Claims, 11 Drawing Sheets

FIG.5
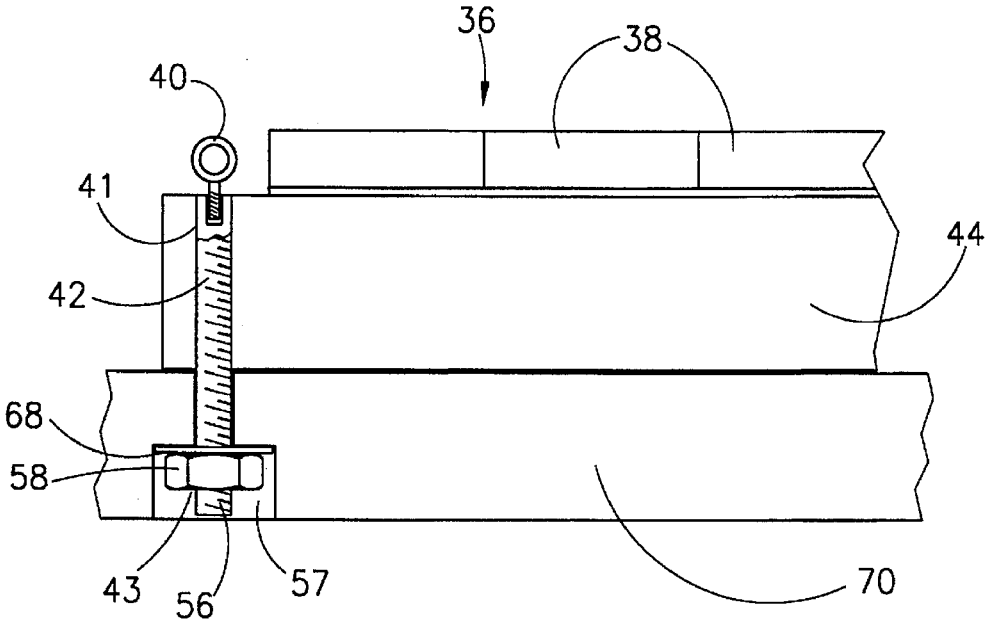
FIG.7A
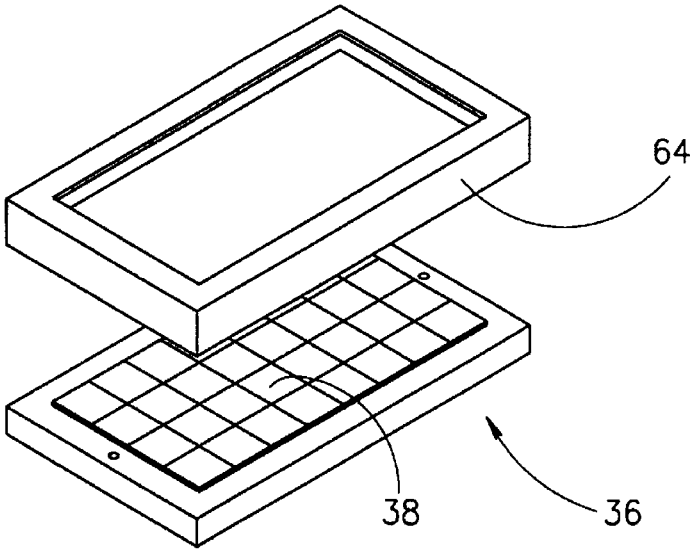
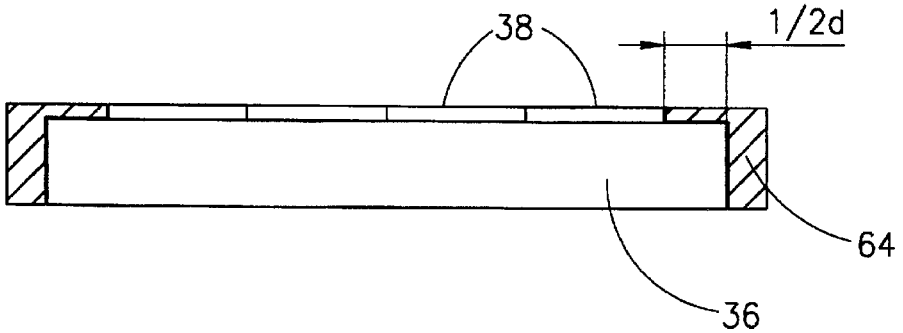
FIG.7B

MODULAR BUILDING SYSTEM

FIELD AND BACKGROUND OF THE INVENTION

The present invention relates to a modular system of building. More specifically, a system of construction is described which includes as prefabricated modules the floors, walls, stairways and elevators, for example, that make up the elements of a modem commercial or residential building.

Today, many areas of the world are experiencing a greater and greater rate of population growth. In most areas, this increasing population growth rate has brought with it an increasing demand for affordable real estate, both commercial and residential. Conventional methods of building entail constructing most if not all the parts of a modem structure at the construction site. Various building elements such as floors, walls, interior structures, etc. are all constructed in serial fashion from the ground up. With building elements that are made out of reinforced concrete, most are originally formed from wooden or steel forms. Custom wooden forms must be constructed to match the desired shape and design of the building. After a structural base frame is assembled, the floors and walls are constructed. In constructing buildings, it is very common to construct the floors and walls (both exterior and interior) from reinforced concrete. After the rough floors and walls are completed, utility lines are then distributed throughout the building. One of the final steps is the finishing of the walls, floors and ceilings. If ceramic tiles are to be laid onto the concrete floor, for example, sand and/or other materials are applied to the rough, usually nonlevel floor. The sand provides a means by which the concrete floor can be leveled so that upon application of the desired final floor material, such as ceramic or stone tiles, the finished floor will be uniform in height.

In many parts of the world, workers who are relatively unskilled or low skilled, are used to construct buildings. Due to this fact, the finished floors in many buildings remain nonlevel to an annoying degree. In addition, the application of less than standard workmanship in a building (in the floors, walls, etc.) during all or a partial number of stages of construction are the cause of numerous problems for the occupants of the finished building. For example, problems such as nonplumb walls, nonlevel floors, developing wall cracks, etc. are commonly the result of poor workmanship. These problems are a constant nuisance and irritant and are expensive to remedy. These problems could irritate occupants enough for them to undergo expensive re-work of various parts of their premises. In the least, these problems would cause numerous complaints to the builders or a homeowner's association.

Another disadvantage with conventional building methods are that they are relatively slow. As previously described, most parts of a building are constructed section by section using wooden forms that must be built up and taken apart over and over again for each section of a building. This process is both tedious and slow. In a multistoried structure, the floor above cannot be built until the floor below is constructed. This imposes a fixed time limitation upon the construction work. In a real estate market with high demand, a long construction time contributes to rising prices. In addition, there is a long amount of time between the start and completion of a building.

SUMMARY OF THE INVENTION

The present invention overcomes the disadvantages and limitations of the prior art by providing a system of constructing a building using modular techniques. The system employs the advantage of using templates to achieve rigid control of module dimensions so that finished floors and walls, for example, are level and plumb, respectively. In addition, the modules have uniform dimensions and can be prefabricated off site at a factory which can be optimized for construction of such modules. This greatly reduces the time to construct a building from start to finish. Finished floor and wall sections can be prefabricated off site in large numbers and rapidly installed at the building site in far less time than it would take to build a building using conventional techniques.

Alternatively, floor, wall, etc. modules may be constructed on site at a temporary fabrication facility setup near the building site. This would eliminate the expense and time of trucking finished building modules or elements from the factory to the building site. Factors considered in determining whether to fabricate on or off site would typically include the distance the raw materials need to travel, distance from the factory to the building site, the cost of trucking the raw materials, the cost of trucking finished modules to the worksite and the time saved in fabricating modules directly at the building site.

The modular building system described below utilizes simple, mechanized processes that can be directly controlled and closely monitored to ensure a high quality for the finished product. Templates or jigs are used for forming the cores or shell of a module. The accurate dimensions and resulting high quality eliminate the irritating unevenness that usually result from custom wooden form construction and uneven concrete filling. In addition, the time consuming process of finishing floors, walls, etc. is eliminated. Also, the relatively high level of skill required to properly finish floors, walls, etc. is eliminated because the process has been mechanized and made uniform so as to allow relatively unskilled labor to produce a high quality product.

Hence, there is provided according to the teachings of the present invention, a modular building system comprising a floor core having suitable thickness and composition for supporting a predetermined mechanical load, the floor core having an upper surface and a lower surface, a floor covering bonded to the upper surface of said floor core, a plurality of lift bolts each having an upper portion and a lower portion, the upper portion embedded vertically within the floor core so as not to extend above the upper surface, the lower portion extending downwardly from the lower surface, the lower portion for securing the floor core to a frame, a floor covering bonded to the upper surface of the floor core, a plurality of removable hooks, each coupled to the upper portion of one of the plurality of lift bolts, the plurality of removable hooks for providing lift points for the floor core, ;a plurality of ceiling bolts each having a top portion and a bottom portion, the top portion embedded vertically within the floor core, the bottom portion extending downwardly from the lower surface, and a plurality of ceiling beams each coupled to one or more of the ceiling bolts, the ceiling beams for providing means for attachment of a ceiling to the lower surface.

While the invention has been described with respect to a limited number of embodiments, it will be appreciated that many variations, modifications and other applications of the invention may be made.

BRIEF DESCRIPTION OF THE DRAWINGS

The invention is herein described, by way of example only, with reference to the accompanying drawings, wherein:

FIG. 5 is an exploded side sectional view of the floor module of FIG. 4;

FIG. 7A is a perspective view of a floor module and a jig or template used in fabricating floor modules in a preferred embodiment of the present invention;

FIG. 7B is a side sectional view of a floor module and a jig or template used in fabricating floor modules in a preferred embodiment of the present invention;

DESCRIPTION OF THE PREFERRED EMBODIMENT

The present invention is of a modular building system employing prefabricated modules for floors, walls, stairways, elevator shafts, etc. that can be manufactured at a fabrication facility located on or off the building site.

The principles and operation of the present invention may be better understood with reference to the drawings and the accompanying description.

The present invention describes a system 10 of building structures, which may rise as high as 10 to 20 stories, that utilizes prefabricated modules for most of the elements that make up the bulk of a building. The fabrication of modules is mechanized to a large degree in order to speed the fabrication of the building. Mechanization also increases the uniformity of the finished modules and reduces the need for skilled labor in the construction of the building.

Figure 1:
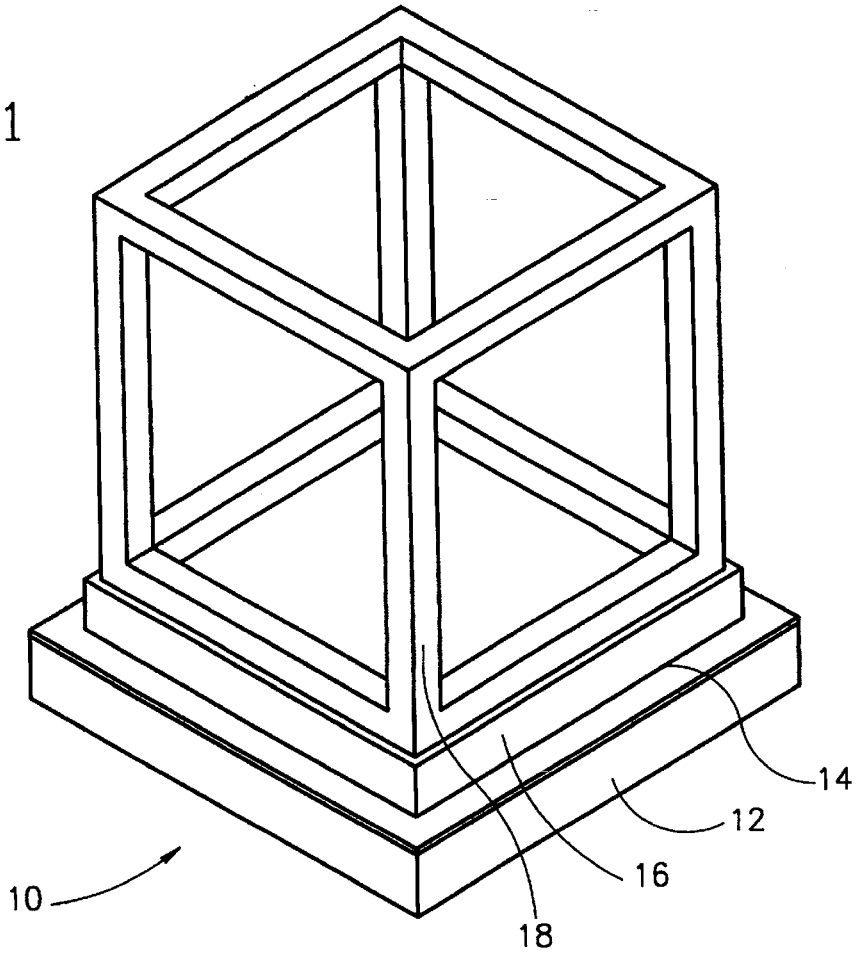
FIG. 1 is a perspective view of the framing structure used in a preferred embodiment of the present invention.
Figure 2:
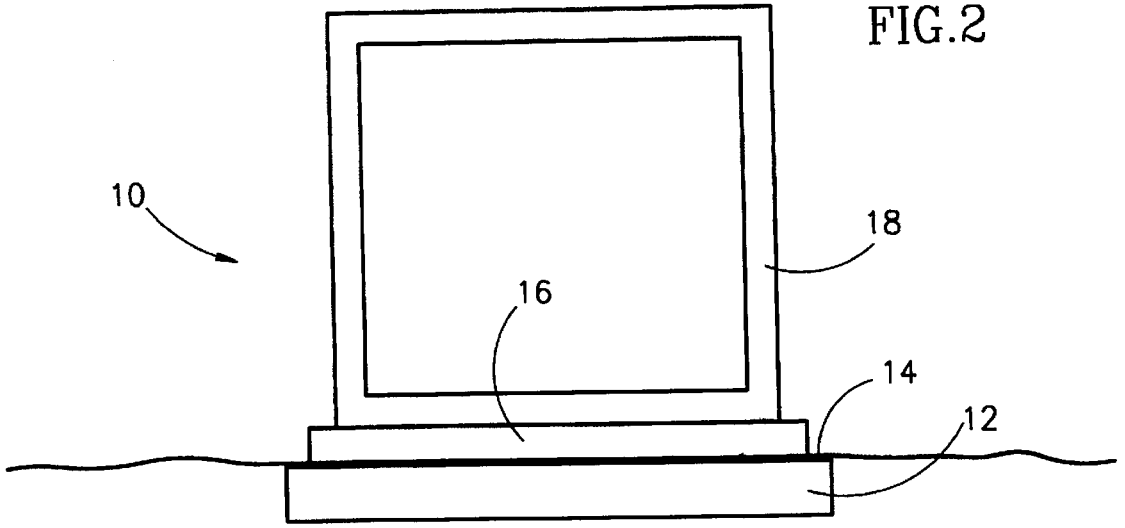
FIG. 2 is a side sectional view of the frame structure of FIG. 1.

A diagram illustrating the framework of an embodiment of the present invention is shown in FIGS. 1 and 2. The framework can be constructed from steel, wood, reinforced concrete or other suitable material that is able to support the mechanical load to be placed on the building. The building site is first excavated, utility services are brought in and then a first foundation 12 is poured. A uniform layer of a suitably flexible material 14, that serves as an expansion layer, is applied upon first foundation 12. Flexible material 14 must have sufficient hardness and smoothness properties. The lower portion of the building's framework, or a second foundation 16 is laid on top of this flex layer 14. Extending from the second foundation 16 are concrete structures 18 (vertical and horizontal columns) needed to support the building.

Figure 3:
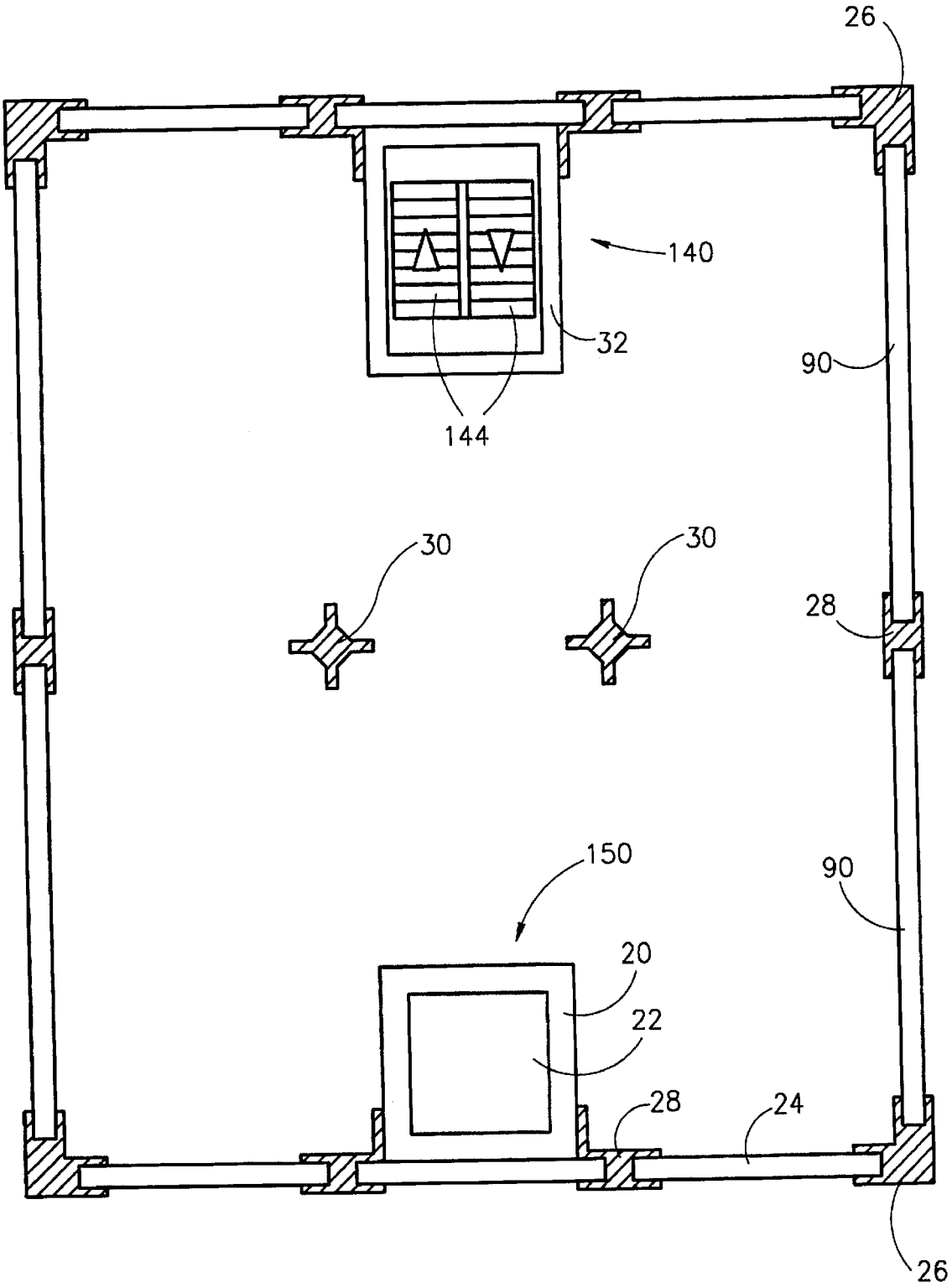
FIG. 3 is a top plan view of the columnar structure, stairway module and elevator module of a preferred embodiment of a present invention.

Shown in FIG. 3 is a top plan layout of a building employing the modular building system. Prefabricated wall modules 90 are held in place by columns, which are constructed upon the second foundation 16. Corner columns 26 are used to join two wall modules in comers of the building. Exterior columns 28 secure two wall modules 90 together. Interior columns 30 join four wall modules 90 together. In addition to joining wall modules together, inner columns 30 may join together conventional type interior walls, built using conventional wooden or metal studs and covered by wallboard or sheetrock. Also shown is an elevator module 150, an elevator shell 20 and an elevator core 22. Elevator core 22 is formed from the void created within elevator shell 20. A stairway module 140 is also shown in FIG. 3. A stairway shell 32 forms an opening wherein steps or stair cases 144 are placed. The layout illustrated in FIG. 3 is one embodiment of the present invention. Buildings having other layouts may be built. However, in each case the modules employing the techniques described herein are utilized. Each module type used in the modular building system will now be described in more detail below.

Figure 4:
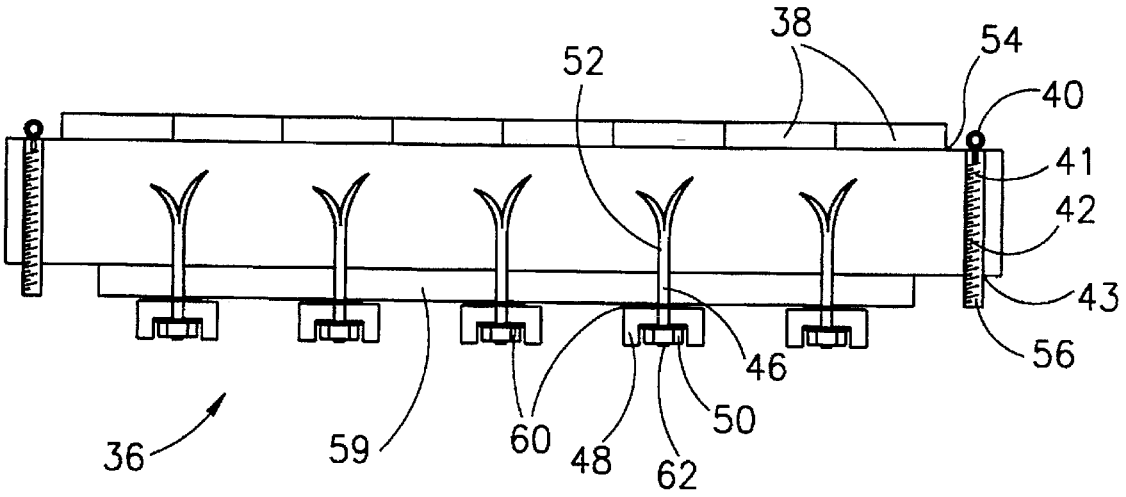
FIG. 4 is a side sectional view of a floor module of a preferred embodiment of the present invention.

A floor module 36 is shown in FIG. 4. Floor modules 36 are made by first fabricating a floor core 44. Floor core 44 may be fabricated from reinforced concrete, wood, or other suitable material adapted to support the load to be placed on it. To ensure consistent dimensions of the possibly large number of floor modules 36 that might be needed to complete a building, a jig or template 64, shown in FIG. 7, is used in the fabrication of floor cores 44. Embedded in the floor core during its fabrication, are two or more lift bolts 42 having an upper portion 41 and a lower portion 43. A detailed sectional view of lift bolts 42 is shown in FIG. 5. Lift bolts 42 are placed in floor core 44 sufficiently deep so that upper portion 41 does not extend beyond the upper surface of floor core 44. Lower portion 43 is threaded and extends below the lower surface of floor core 44. Lift bolts 42 are used to facilitate lifting of floor modules 36 so they can be installed using a crane or other lifting facility.

Coupled to upper portion 41 of lift bolts 42 are removable hooks 40. Removable hooks 40 are eye hooks that may be an open or closed type hook. During fabrication of floor modules 36, removable hooks 40, used for transportation and installation purposes, are inserted into and coupled to lift bolts 42. Upon installation in a building they are removed.

Figure 13:
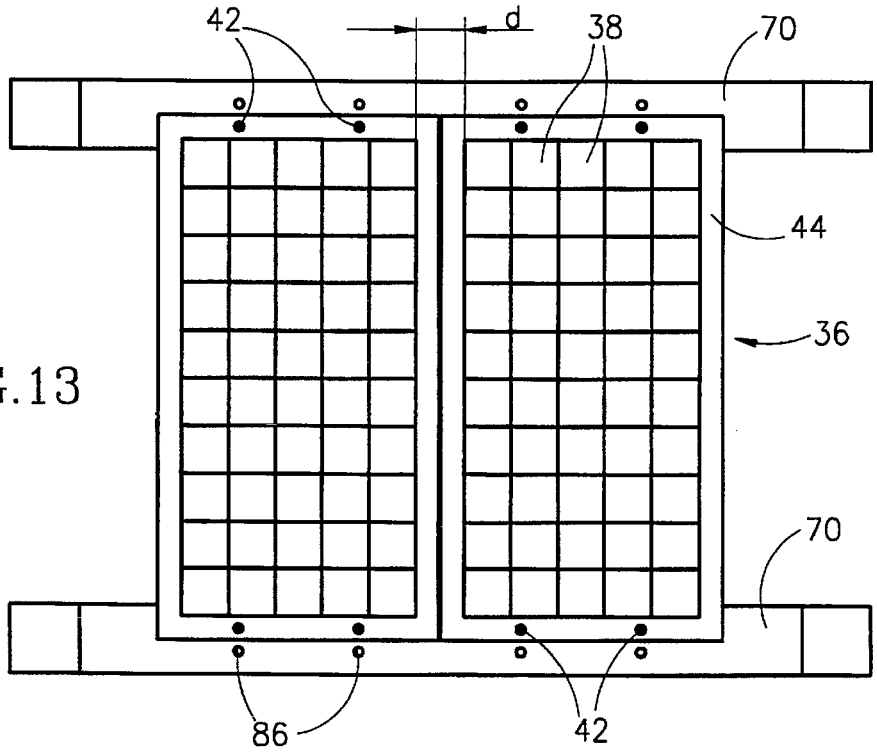
FIG. 13 is a top plan view illustrating the fastening of two floor modules to columns in a preferred embodiment of the present invention.

Applied to the upper surface of floor core 44 is a layer of adhesive or bonding agent 54. On top of adhesive 54 is applied a floor covering 38. Floor covering 38 may be any type of flooring material such as ceramic tile, linoleum, etc. For example if ceramic tiles are to be used, after adhesive 54 is applied, ceramic tiles 38 are laid across the upper surface of floor core 44. After application of ceramic tiles uniform compression is applied between the upper and lower surfaces of floor module 36 so that the resultant height of each tile 38 is a uniform amount. This ensures that after floor modules 36 are laid into place the height of each floor module. 36 will be uniform and its surface level. To simplify the fabrication of floor modules 36, dimensions for floor core 44 are chosen such that an even number of tiles 38 fit within the surface area of floor core 44. In addition, the dimensions of floor core 44 are such that a border, free of tiles, is left around the perimeter of floor core 44 that measures approximately one half the width of a tile 38, as shown in FIG. 13. This border is created around the perimeter surface of floor core 44 so that after floor modules 36 are laid next to one another, the gaps between them will be approximately the width of a tile 38.

Figure 6:
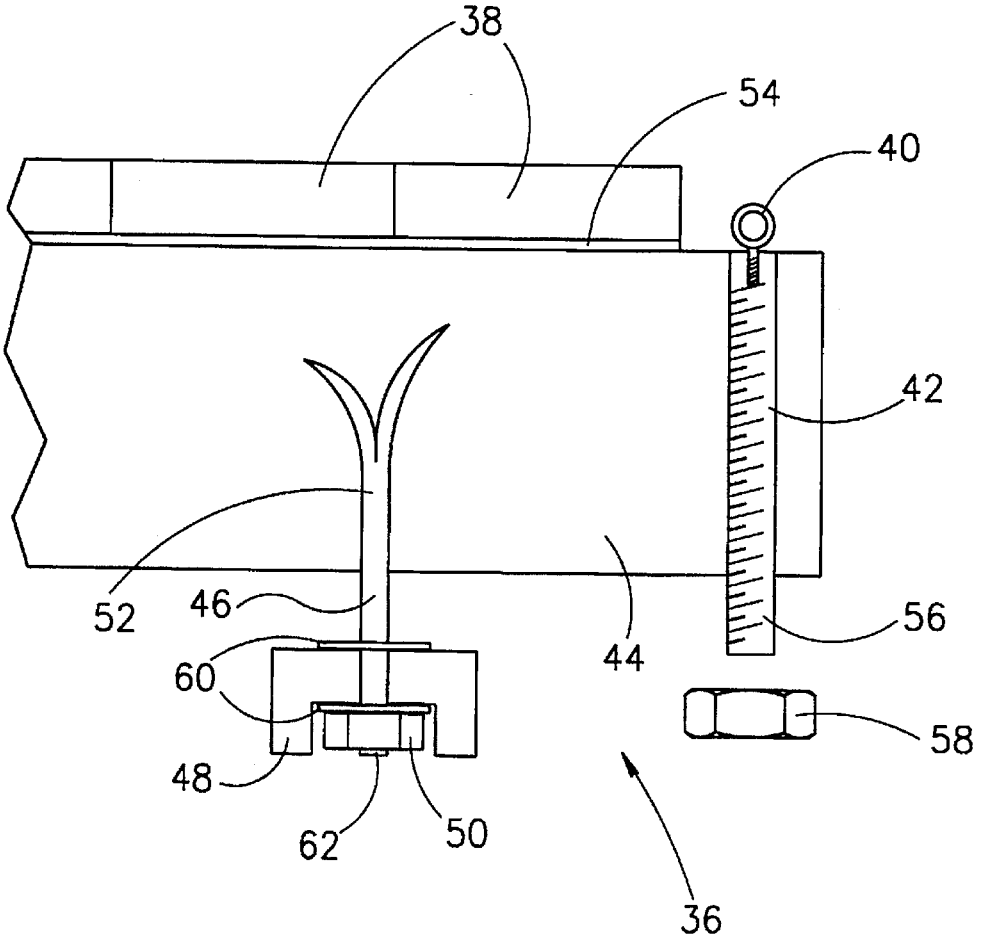
FIG. 6 is an exploded side sectional view of the floor module of FIG. 4.

Embedded within floor core 44 are ceiling bolts 46. An exploded sectional view of ceiling bolts 46 is shown in FIG. 6. The purpose of ceiling bolts 46 are to provide support for a layer of insulation 59 and a ceiling which are to be installed directly below. The upper portion 52 of ceiling bolts 46 are embedded within floor core 44. The lower part of ceiling bolt 46 includes a threaded portion 62. Attached to each ceiling bolt 46 are spacer disks 60. A plurality of ceiling beams 48 support insulation layer 59 and secure it to the lower surface of floor core 44. A nut 50, attached to threaded portion 62, secures ceiling beam 48 to ceiling bolt 46.

Figure 8:
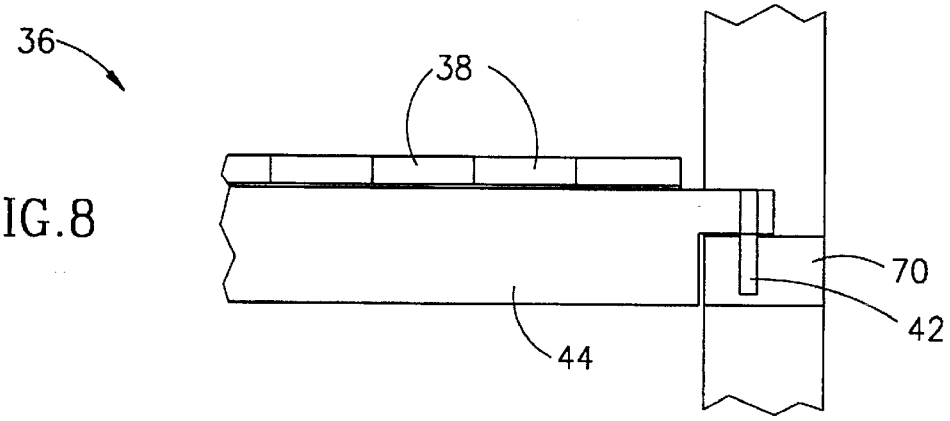
FIG. 8 is side sectional view illustrating the fastening of a floor module to a column in a preferred embodiment of the present invention.
Figure 9:
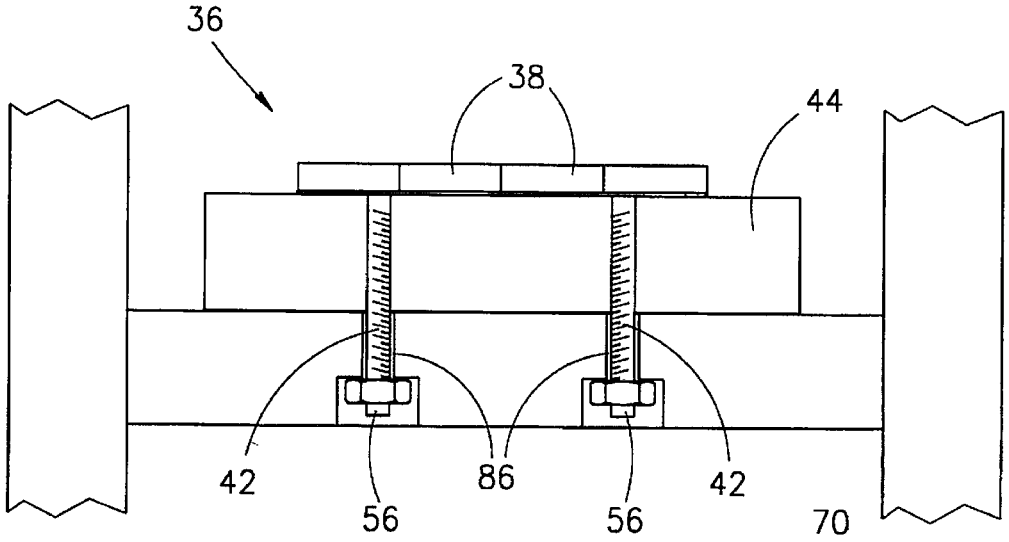
FIG. 9 is a front sectional view illustrating the fastening of a floor module to a column in a preferred embodiment of the present invention.

Shown in FIGS. 8 through 13 are embodiments of the present invention illustrating the coupling of floor modules 36 to a section of building frame 70. Within the building, frame 70 is constructed such that on each floor, openings exist matching the dimensions of floor modules 36. Holes 86 are drilled into or made at the time of fabrication of frame 70. Floor modules 36 are subsequently placed into these openings within frame 70 and lower portions 43 of lift bolts 42 are inserted into holes 86. Nuts 58 are then applied to threaded portion 56 of lift bolts 42 to secure floor modules 36 to frame 70. Such a connection is illustrated in FIG. 5. Spacers or washers 68 are placed between nut 58 and hollowed out section 57 of frame 70. Two side views of floor module 36, showing lift bolt 42 inserted into hole 86 within frame 70, are illustrated in FIGS. 8 and 9.

Figure 10:
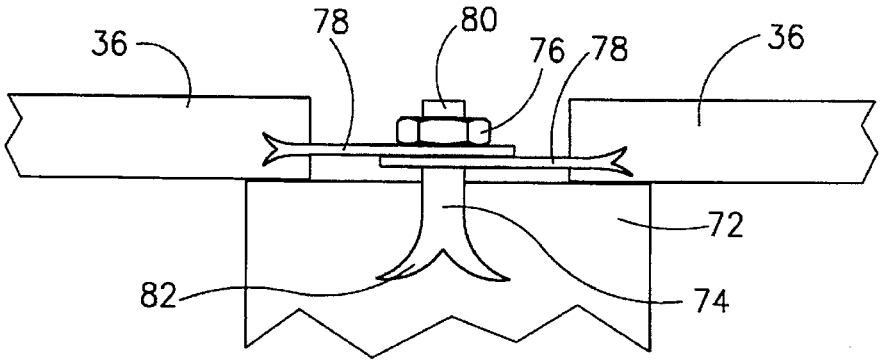
FIG. 10 is side sectional view illustrating the fastening of two floor modules to a column in a preferred embodiment of the present invention.
Figure 11:
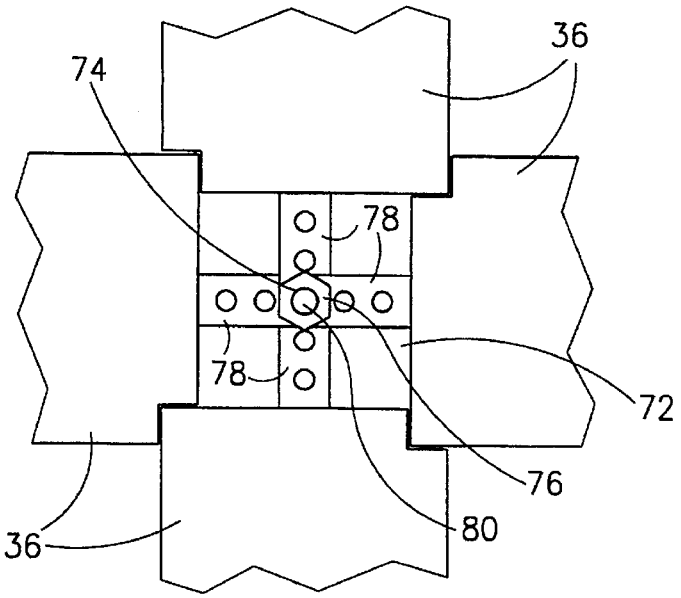
FIG. 11 is a top sectional view illustrating the fastening of four floor modules to a column in a preferred embodiment of the present invention.

Shown in FIG. 10 is a side sectional view of a preferred embodiment of the present invention illustrating the connection of two floor modules 36 to column 72. Fastening tabs 78 are embedded within floor modules 36 at the time of fabrication. An eye formed in the end of fastening tabs 78 is placed around fastening bolt 74 embedded in column 72. Split tail portion 82 helps secure fastening bolt 74 to column 72. Threaded portion 80 of fastening bolt 74 receives a nut 76 to secure floor modules 36 to column 72. Shown in FIG. 11 is a top plan view of four floor modules 36 secured to column 72. Fastening tabs 78 embedded in floor modules 36 are secured to threaded portion 80 of fastening bolt 74 with nut 76.

Figure 12:
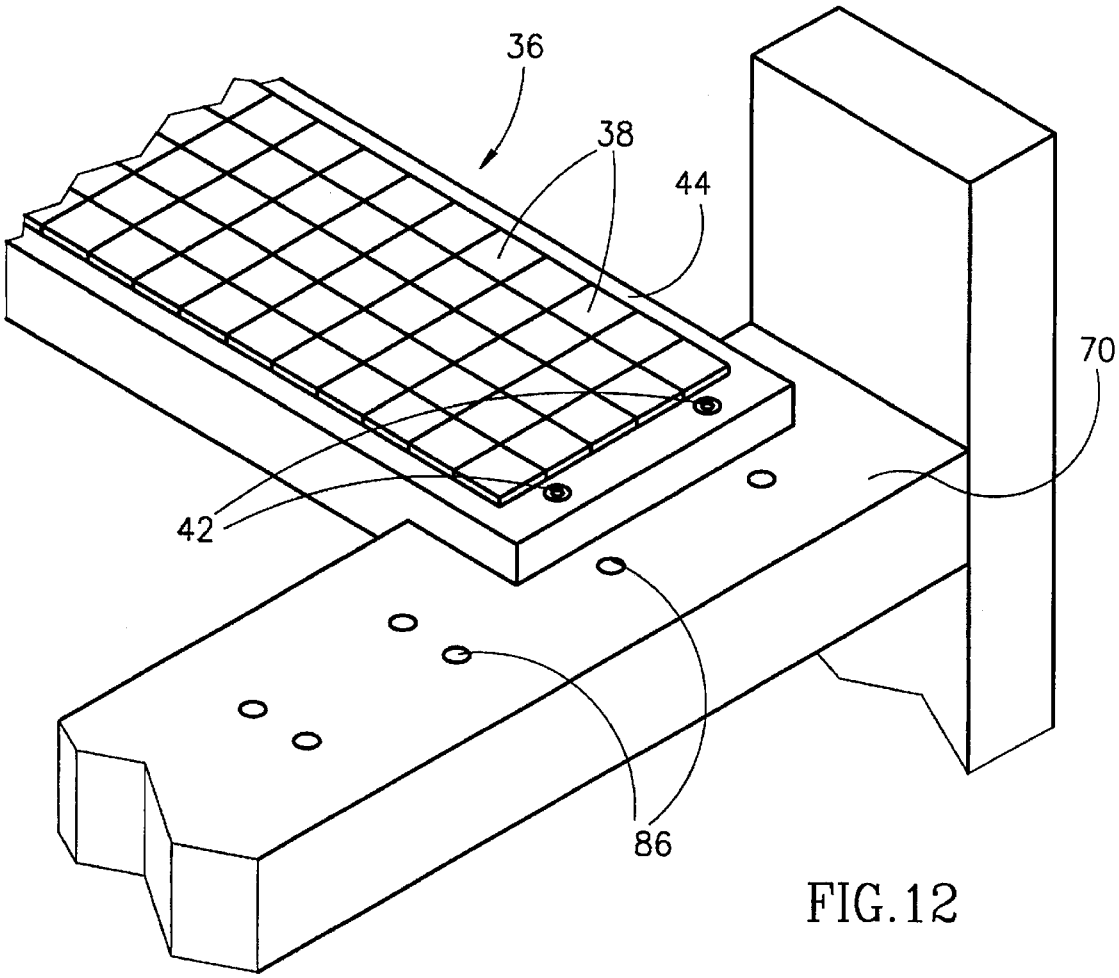
FIG. 12 is a perspective view illustrating the fastening of a floor module to a column in a preferred embodiment of the present invention.

Shown in FIG. 12 is a perspective view illustrating the connection of floor module 36 to frame 70. Lift bolts 42 are inserted through holes 86 and secured with nuts 58. Also illustrated in FIG. 12 are tiles 38 and floor core 44. FIG. 13 illustrates the placement of two floor modules 36 to frame 70. Floor module 36 is suitably sized so that distance 'd' is approximately the width of a ceramic tile 38. Distance 'd' preferably is accurate to within an accuracy of +/−2 millimeters. As mentioned previously, template 64 is designed so that a border, having a width of approximately one half the width of a tile 38, around the perimeter of floor core 44 does not receive any tiles 38.

Figure 14:
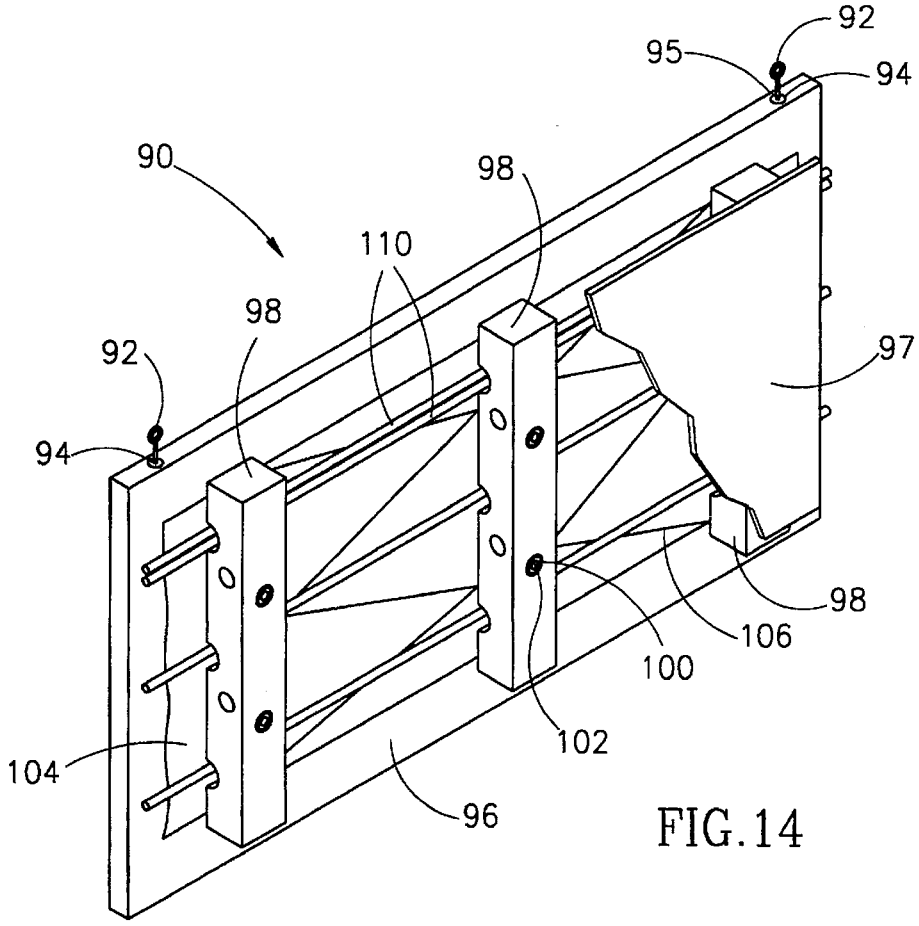
FIG. 14 is a side sectional view of a wall module of a preferred embodiment of the present invention.

A side view of a wall module 90 is shown in FIG. 14. Wall modules 90 are fabricated by initially forming wall core 96 made out of a suitable material such as reinforced concrete or wood. The dimensions of wall core 96 are chosen so that the mechanical load to be placed on it can be sustained. Two or more rods 95 are embedded in wall core 96. The upper portion of rods 95 have internally threaded holes designed to receive the threaded portion 94 of removable hooks 92. Rods 95 are vertically embedded sufficiently deep within wall core 96 so that they do not extend beyond the top surface of wall core 96. Removable hooks 92, utilized during transport and installation of wall modules 90, may be either open eye or closed eye type hooks. After installation removable hooks 92 are removed.

Figure 15:
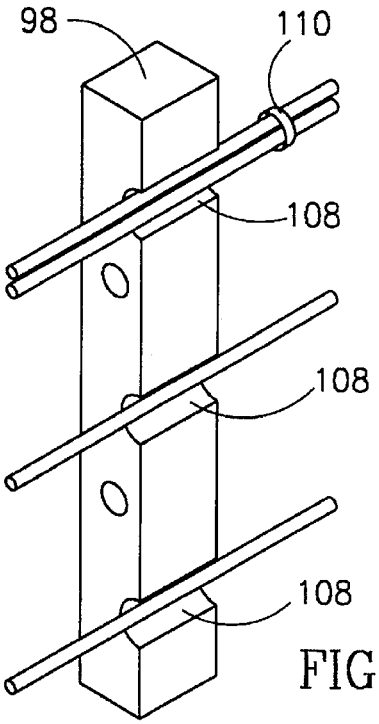
FIG. 15 is a side perspective view of a wall beam shown in FIG. 14.

Insulation 104 may be applied to the inner surface of wall core 96. Subsequently, wall beams 98 are installed and secured to wall core 96 by a plurality of wall bolts 100 and nuts 102. Insulation 104 may additionally be secured to wall core 96 by rope 106 or by other suitable means such as an adhesive. Shown in FIG. 15 is an enlarged view of wall beam 98. Within each wall beam 98 are one or more channels or passageways 108 that may be grooved out or drilled through wall beam 98. Utility services such as electrical cabling, plumbing, cooling pipes, heating pipes, communication cables, etc. pass through channels 108. The assembly of utility related material and equipment, including plumbing, cabling, etc., can be customized for each wall module 90 in accordance with a floor plan or architect's blue print. Wall core 96 is fabricated using a jig or template in order to produce wall modules 90 having accurate and uniform dimensions.

Wall beams 98 provide a means for the attachment of a wall covering 97 that is attached after the utilities have been placed. Typically wall covering 97 includes sheetrock or wallboard, but might include wood paneling or other type of wall coverings.

Figure 16:
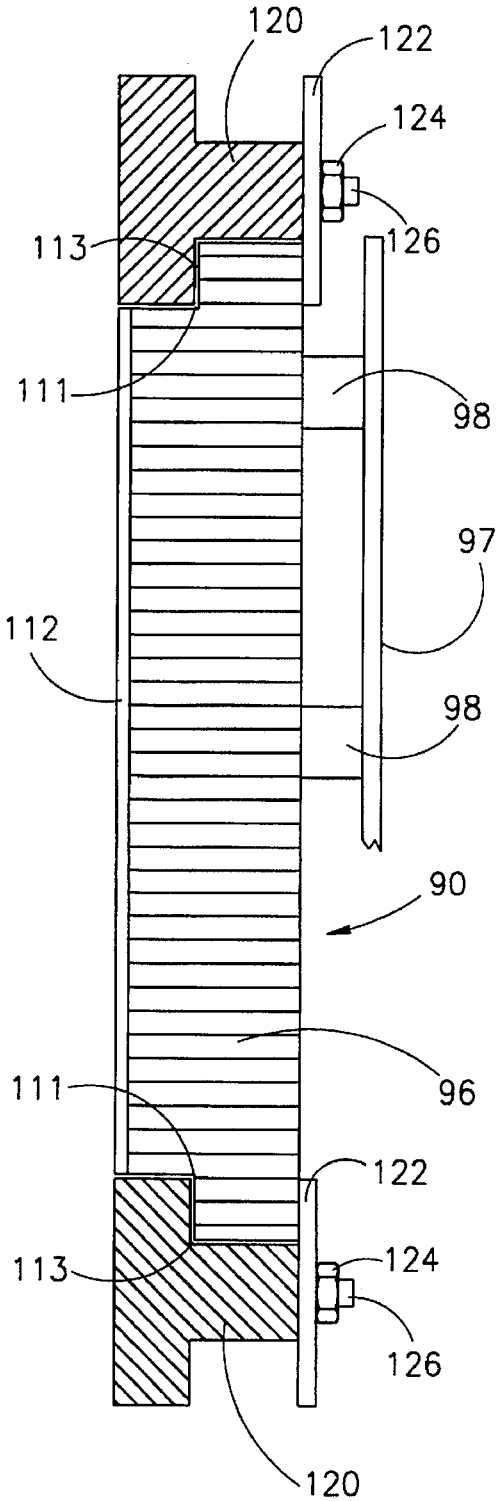
FIG. 16 is a top sectional view illustrating the fastening of a wall module to columns in a preferred embodiment of the present invention.
Figure 17:
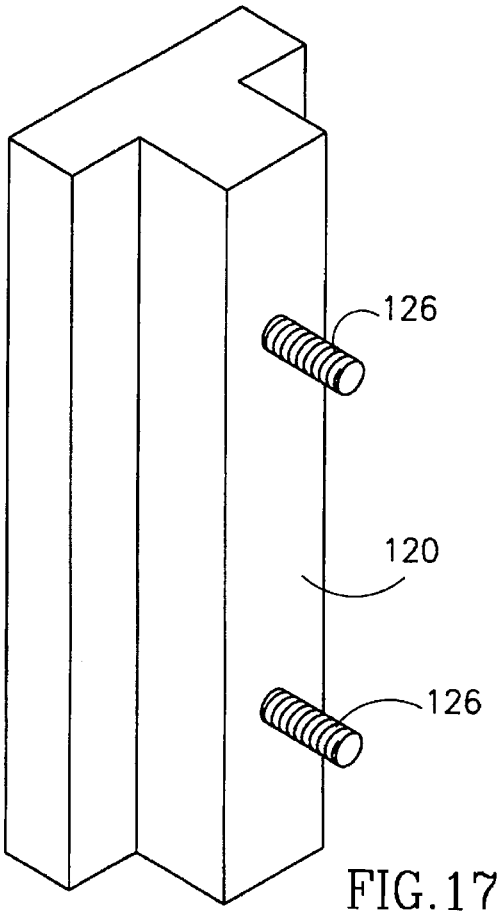
FIG. 17 is a perspective view of a column of a preferred embodiment of the present invention.

In a preferred embodiment of the present invention wall modules 90 are secured to columns 120 using a technique illustrated in FIG. 16. An exterior wall covering 112 is shown bonded to the exterior surface of wall core 96. Exterior wall covering 112 may include ceramic tiles, glass, wood, shingles, or any other suitable exterior siding material. The top plan view of FIG. 16 illustrates notches 111 built into wall module 90. Notches 111 fit into columns 120 and wall modules 90 and are secured to columns 120 by hold down plates 122. Plates 122 are secured to columns 120 by bolts 126, embedded in columns 120, and nuts 124. Gaps 113 are filled with a suitable sealing material, such as silicon, that is flexible and has adequate sealing properties. Also shown are wall beams 98 supporting wall covering 97. Shown in FIG. 17 is a perspective view of column 120 showing bolts 126 embedded therein.

Figure 18:
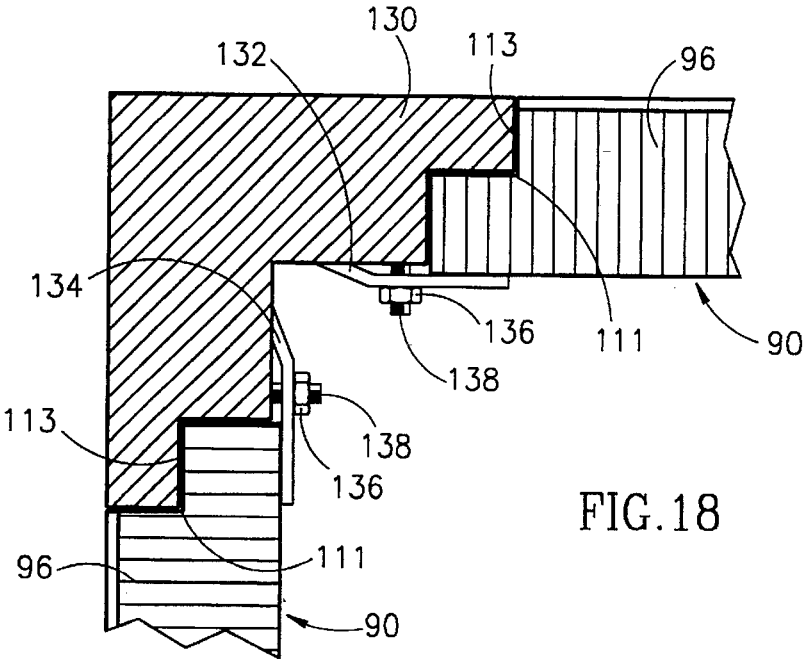
FIG. 18 is top plan view illustrating the fastening the two wall modules to a corner column in a preferred embodiment of the present invention.

A corner column 130 and two wall modules 90 attached thereto is shown in FIG. 18. Notches 113 in wall core 96 fit into complementary structures formed in column 130. Clamping plates 132 secure wall modules 90 to column 130 via a compression fitting. A flexible sealing material, such as silicon, is applied within the gap 113 between wall cores 96 and column 130. Bolts 138 are embedded during or after the fabrication of column 130. Nuts 136 secure clamping plates 132 to column 130 and compress wall modules 90 into column 130.

Figure 19:
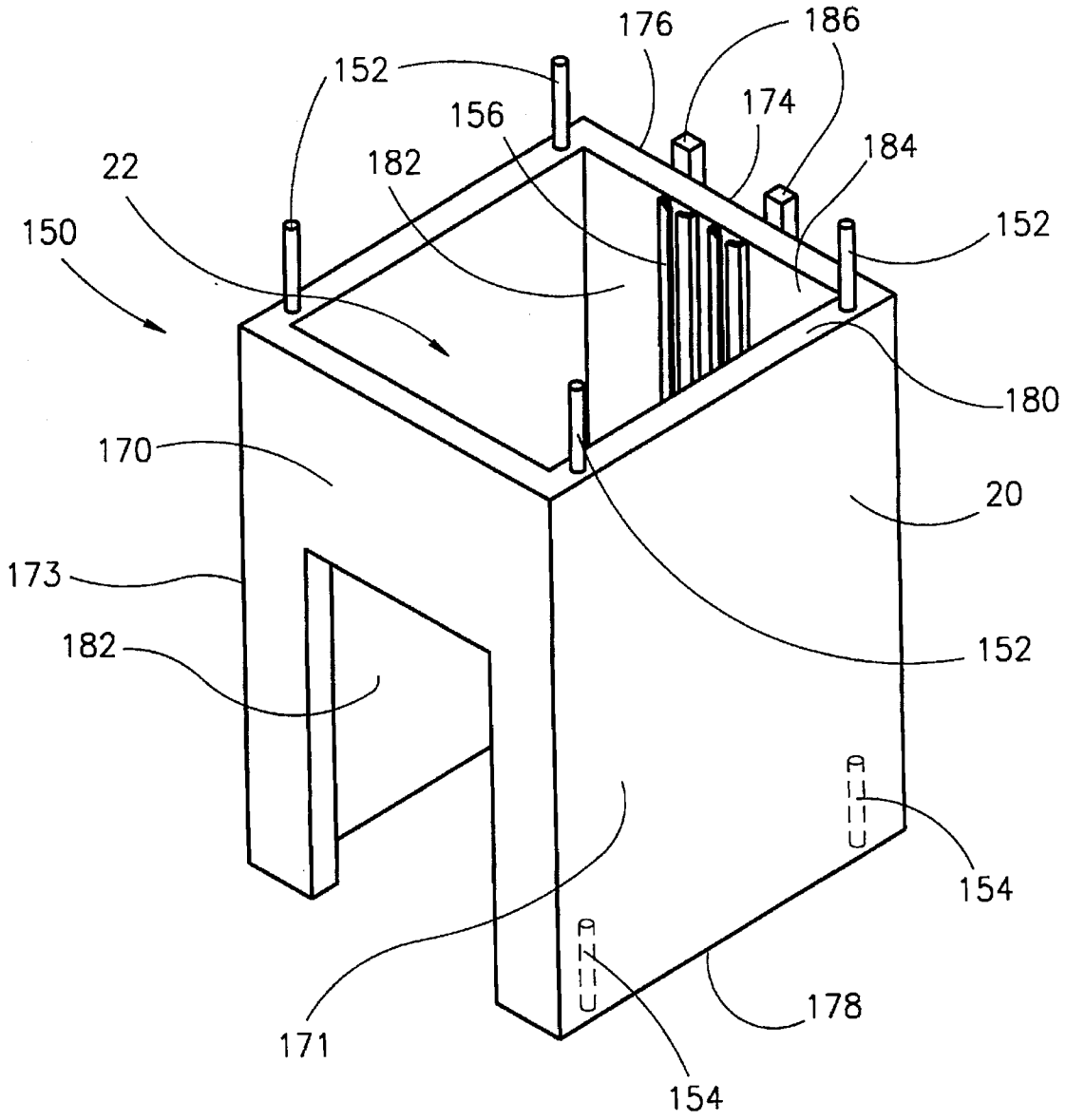
FIG. 19 is a perspective view of an elevator module of a preferred embodiment of the present invention.
Figure 22:
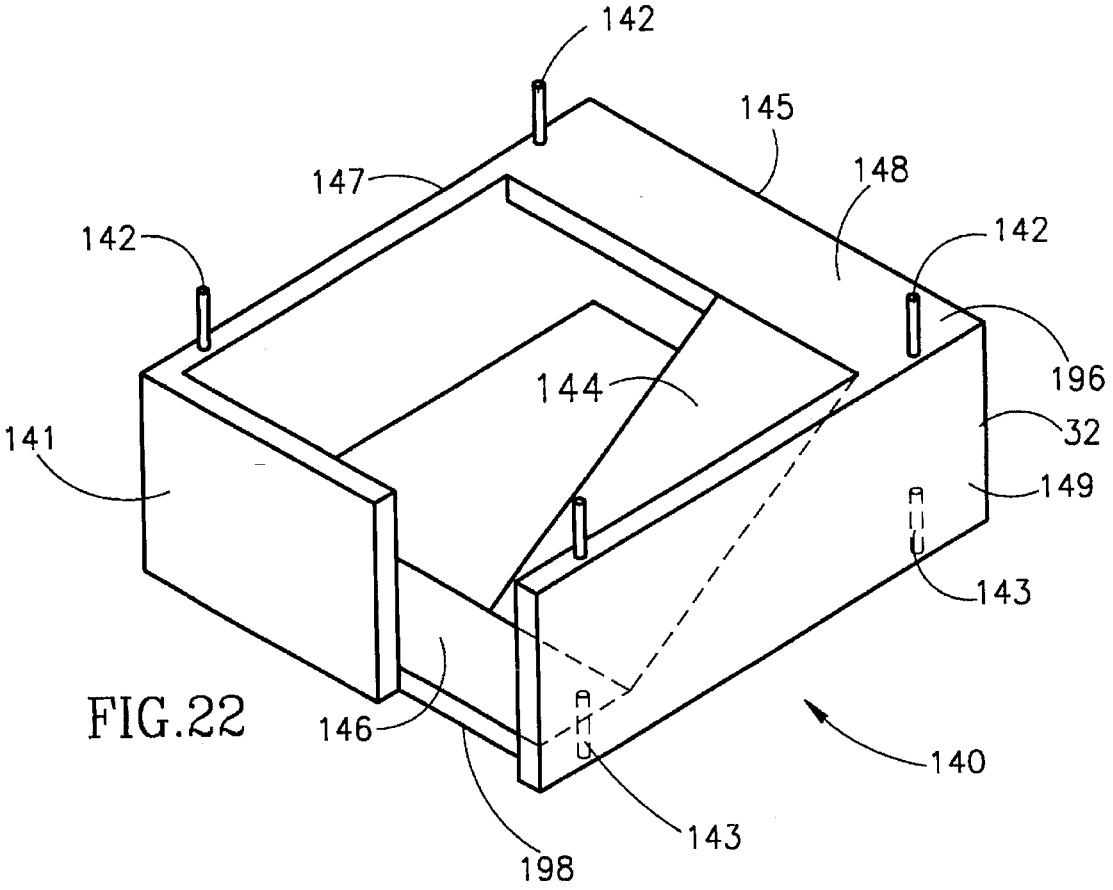
FIG. 22 is a perspective view of a stairway module of a preferred embodiment of the present invention.
Figure 23:
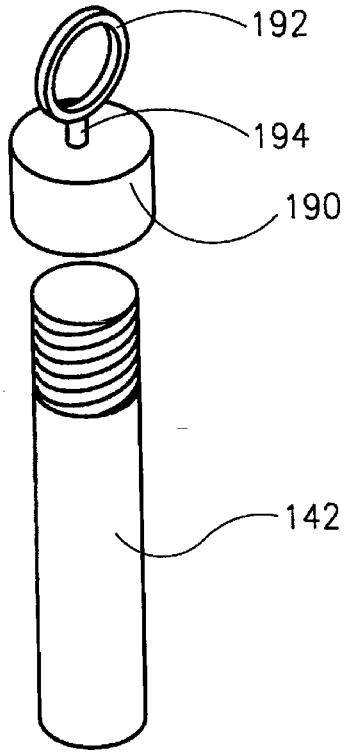
FIG. 23 is a sectional view of the lift point attached to the pins of the stair way modules.

In buildings having more than a few floors, an elevator is typically required by the local building code. The modular building system includes an elevator module 150, shown in FIG. 19, that may be stacked one upon the other as many times as needed. An elevator shell 20 is formed from suitable material such as reinforced concrete having sufficient thickness to sustain the mechanical load to be placed on it. Elevator shell 20 includes a front portion 170, rear portion 176, left surface 173, right surface 171, an upper surface 180 and a lower surface 178. Rear portion 176 has an inner surface 184 and an outer surface 174. Front portion 170 includes an open portion 182 of suitable dimensions to be able to accommodate elevator doors. Four or more vertical holes 154 extend from lower surface 178 upward and are formed in elevator shell 20 during or after fabrication. Four or more pins 152 are embedded vertically within upper surface 180. Pins 152 from elevator shell 20, located on the floor below, fit into complementary shaped holes 154 formed in elevator shell 20 located on the immediate floor above.

Elevator tracks 156 are vertically oriented on and attached to inner surface 184 of rear portion 174 and extend approximately the vertical height of elevator shell 20. Elevator tracks 156 provide a suitable mechanical guide for the up and down travel of an elevator car. Vertical beams 186 are affixed to the outer surface 174 of rear portion 176. Elevator shell 20 is secured to fixed columns 30 or to columns 28 by positioning the columns between vertical beams 186. Appropriate fastening means is used to affix the vertical beams 186 to the columns.

Wall beams can be attached to left surface 173 and right surface 171. Wallboard or sheetrock 98 can then subsequently be attached to the wall beams in order that elevator shell 20 be partially covered.

Elevator modules 150 can be stacked one atop the other for multi-story buildings. A suitably flexible material, having appropriate hardness and smoothness properties is applied between lower surface 178 and upper surface 180.

Figure 20:
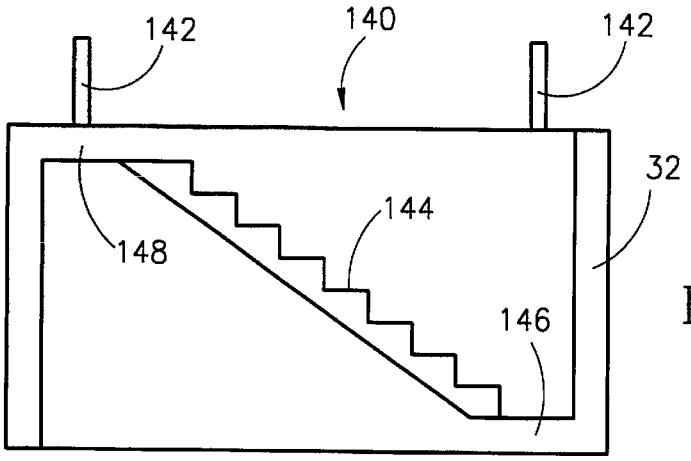
FIG. 20 is a side sectional view of a stairway module of a preferred embodiment of the present invention.
Figure 21:
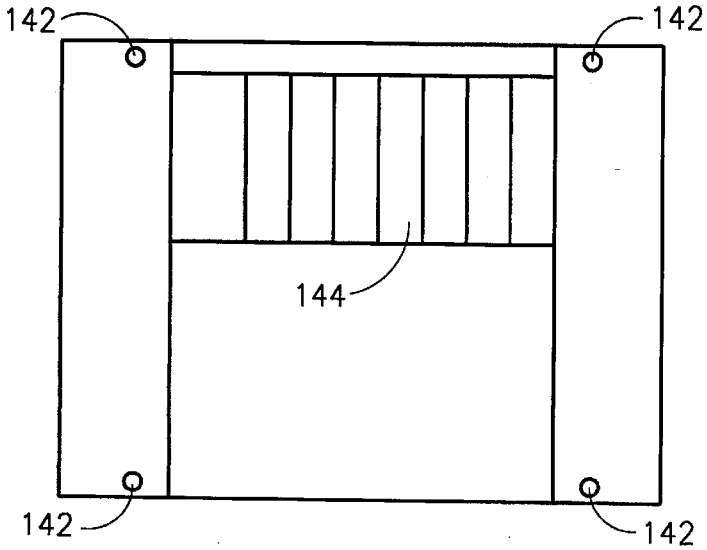
FIG. 21 is a top sectional view of a stairway module of a preferred embodiment of the present invention.

Stairway module 140, whose side sectional view is shown in FIG. 20, is also included in the modular building system. For each floor to be constructed, stairway module 140 includes two stairway shells 32 (i.e. a lower and upper stairway shell) placed one atop the other. Stairway shells 32 are fabricated from a suitable material such as reinforced concrete. Both lower and upper stairway shells 32 are identical in construction except that the location of a plurality of steps 144, fabricated within each stairway shell, alternates between the left and right sides. Stairway shells 32 include a front portion 141, rear portion 145, left side 147, right side 149, upper surface 196 and lower surface 198. Each lower portion includes an opening in front portion 141, on either the left or fight side, to allow access to stair module 140.

Stairway shell 32 includes a lower landing 146 extending from front portion 141 to a the start of plurality of steps 144. Steps 144 extend from lower landing 146 to an upper landing 148. Extending from the top of the last step to rear portion 145 is upper landing 148. Located at suitable points around stairway shell 32 are a plurality of pins 142. Pins 142 are embedded in upper surface 196 and extend upward a sufficient distance to provide a suitable interface to a complementary plurality of holes 143. Holes 143, located in lower surface 198, are adapted to receive pins 142 from stairway shell 32, placed below. Two stairway shells 32 make up each floor, a lower stairway shell mated with an upper stairway shell. When stacking stairway modules 140, a suitable flexible material, having appropriate hardness and smoothness properties is added between upper surface 196 and lower surface 198.

Each pin 142 includes a removable pin cap 190 and a lift hook 192. Threaded portion 194 is secured to removable pin cap 190. Four hooks 192 are used to facilitate lifting stairway shells 32. Pin caps 190, along with lift hooks 92, are removed after the installation of stairway modules 140.

Wall beams and wallboard or sheetrock can be fastened to stairway shell 32 in order to cover the surface of shell 32. The interior surfaces of stairway shell 32 can be hidden using wall beams and wallboard or the interior surface can be painted.

Stairway module 140 can be built strong enough to be effectively used to protect against bomb or missile attacks or earthquakes, for example.

In addition to the modules and elements described above, the modular building system includes components that may be found outside of actual occupant premises (i.e. in hall ways) such as electrical closets and utility conduits containing related plumbing, water and gas distribution lines, telephone lines and other utilities. A section of conduit, spanning a distance of a single floor, can be prefabricated at a factory located on or off site. Each standard section of conduit would include multiple isolated conduits for maintaining sufficient isolation of power, telecommunication, fire/security cables, gas and water related plumbing, etc. Placed at a suitable point along the conduit are one or more access closets for the installation of electric, gas and water meters, telecommunication terminals or other utility related service gear. Utility connections between floors and from the electrical closets to each unit would still be required to be made by skilled labor.

The modular building system described above can be successfully applied to most of the structural elements of a modem building. There are, however, other elements that would be more efficiently constructed using conventional building techniques (e.g., such as interior walls composed of wall studs and wallboard).

While the invention has been described with respect to a limited number of embodiments, it will be appreciated that many variations, modifications and other applications of the invention may be made.

What is claimed is:

1. A modular building system comprising:

a floor core having suitable thickness and composition for supporting a predetermined mechanical load, said floor core having an upper surface and a lower surface;

a floor covering bonded to said upper surface of said floor core;

a plurality of lift bolts each having an upper portion and a lower portion, said upper portion embedded vertically within said floor core so as not to extend above said upper surface, said lower portion extending downwardly from said lower surface, said lower portion for securing said floor core to a frame;

a plurality of removable hooks, each coupled to said upper portion of one of said plurality of lift bolts, said plurality of removable hooks for providing lift points for said floor core;

a plurality of ceiling bolts each having a top portion and a bottom portion, said top portion embedded vertically within said floor core, said bottom portion extending downwardly from said lower surface; and a plurality of ceiling beams each coupled to one or more of said ceiling bolts, said ceiling beams for providing means for attachment of a ceiling to said lower surface.

2. The modular building system according to claim 1, wherein the composition of said floor core comprises reinforced concrete.

3. The modular building system according to claim 1, further comprising an insulation layer secured between said lower surface of said floor core and said plurality of ceiling beams.

4. The modular building system according to claim 1, wherein said floor covering comprises ceramic tiles.

5. A method of constructing a floor module as part of a modular building system, said method comprising the steps of:

fabricating a floor core having suitable thickness and composition for supporting a predetermined mechanical load, said floor core having an upper surface and a lower surface;

bonding a floor covering to said upper surface of said floor core;

providing a plurality of lift bolts each having an upper portion and a lower portion, said lower portion for securing said floor core to a frame;

vertically embedding said upper portion of said lift bolts within said floor core so as not to extend above said upper surface, said lower portion of said lift bolts extending downwardly from said lower surface;

providing a plurality of removable hooks for providing lift points for said floor core;

coupling each of said removable hooks to said upper portion of one of said lift bolts;

providing a plurality of ceiling bolts each having a top portion and a bottom portion;

vertically embedding said top portion of said ceiling bolts within said floor core, said bottom portion of said ceiling bolts extending downwardly from said lower surface;

providing a plurality of ceiling beams for providing means for attachment of a ceiling to said lower surface; and coupling each of said ceiling beams to at least one of said ceiling bolts.

6. The method according to claim 5, further comprising the step of securing an insulation layer between said lower surface of said floor core and said plurality of ceiling beams.

* * * * *